United States Patent [19]

Sease et al.

[11] 4,159,459

[45] Jun. 26, 1979

[54] NON-INDUCTIVE CYLINDRICAL THIN FILM RESISTOR

[75] Inventors: D. Lamar Sease, Rouzerville, Pa.; Benjamin Solow, North Hollywood, Calif.; Eduard F. Boeckmann, Hagerstown; David Rabinow, Rockville, both of Md.

[73] Assignee: Angstrohm Precision, Inc., Hagerstown, Md.

[21] Appl. No.: 809,469

[22] Filed: Jun. 23, 1977

[51] Int. Cl.[2] ..... H01C 3/02

[52] U.S. Cl. ..... 338/61; 29/620; 338/292; 338/294; 338/308; 427/102; 427/124; 427/126

[58] Field of Search ..... 338/61, 62, 292, 294, 338/308, 307, 309, 195; 219/216, 543; 29/620, 610; 427/101-103, 122-124, 126

[56] References Cited

U.S. PATENT DOCUMENTS

| | | | |
|---|---|---|---|
| 1,771,236 | 7/1930 | Schellenger | 338/195 X |
| 1,847,653 | 3/1932 | Jones et al. | 338/195 |
| 2,730,598 | 1/1956 | Lytle | 338/195 X |
| 2,828,639 | 4/1958 | De Ronde et al. | 74/206 |
| 3,337,832 | 8/1967 | Hukee | 338/195 X |
| 3,530,573 | 9/1970 | Helgeland | 219/121 R X |
| 3,539,309 | 11/1970 | Helgeland | 219/121 EB X |
| 3,803,708 | 4/1974 | Wada et al. | 338/294 X |
| 3,845,443 | 10/1974 | Fisher | 338/292 X |
| 3,858,147 | 12/1974 | Caddock | 338/62 |
| 3,880,609 | 4/1975 | Caddock | 338/62 X |
| 4,007,352 | 2/1976 | Ura | 219/216 |
| 4,016,525 | 4/1977 | Maher et al. | 338/308 X |

FOREIGN PATENT DOCUMENTS

| | | | |
|---|---|---|---|
| 1314388 | 4/1973 | United Kingdom | 338/195 |

*Primary Examiner*—C. L. Albritton
*Attorney, Agent, or Firm*—Fisher, Christen & Sabol

[57] ABSTRACT

A thin film, cylindrical resistor is disclosed which exhibits non-inductive characteristics and which may be fabricated easily and economically. A cylindrical insulative substrate is provided with electrically conductive termination bands and a thin coating of electrically resistive material over the entire cylindrical surface. The resistive material is then cut along an axial path and along an interrupted spiral path so as to form the resistive material into a serpentine path along the cylindrical substrate. Leads are attached to each end and as the current traverses the length of the cylinder it travels in a serpentine path. The current travels in opposite directions along adjacent parallel portions of the path thereby cancelling out the major portion of inductance.

11 Claims, 4 Drawing Figures

NON-INDUCTIVE CYLINDRICAL THIN FILM RESISTOR

FIELD OF THE INVENTION

The invention relates to non-inductive resistance devices, more particularly non-inductive thin film cylindrical resistors.

BRIEF DESCRIPTION OF THE PRIOR ART

Non-inductive cylindrical resistors per se are known (U.S. Pat. Nos. 3,858,147 and 3,880,609) which have a resistive serpentine path on an insulating substrate. However, the resistive path is formed by a resistive ink material which is silk-screened onto the insulating cylindrical base. This method of forming the resistive path is time consuming and requires accurate alignment of the minute clindrical substrate with the silk-screening apparatus.

It is also known to coat a cylindrical, insulating substrate with a thin resistive film and make a spiral cut through the film, such as with a laser beam or electron beam, thereby defining a spiral current path along the cylinder (U.S. Pat. Nos. 3,539,309; 3,530,573; and 2,828,639). The resistors made by this method are inductive due to the unidirectional current flow, the degree of inductance depending upon the number of turns in the spiral path.

Resistors having a serpentine current paths on a flat, insulating substrate, and methods of making them are well known to those skilled in the art. However, these are often undesirable due to geometry required for military and industrial specifications.

SUMMARY OF THE INVENTION

In accordance with the invention, a cylindrical insulating substrateis provided with a thin, coating of resistive material over the major portion of its cylindrical surface. A first cut is made through the conductive material parallel to the longitudinal axis of the cylinder. A second cut is then made in an interrupted spiral path such that the resistive material forms a serpentine path for the current traveling through the resistor. The cuts may be made by focusing a laser beam on the resistive material and moving it along a straight line to form the axial cut, and rotating the cylinder while traversing the beam to form the interrupted spiral cut. The beam is shut off during a portion of the cylinder rotation to make the spiral cut discontinuous. A connecting lead is attached to each end of the substrate in electrical contact with the resistive film via a termination band. The resistor may be hermetically sealed or encapsulated if desired.

DETAILED DESCRIPTION OF THE PREFERRED EMBODIMENT

Figure 1:
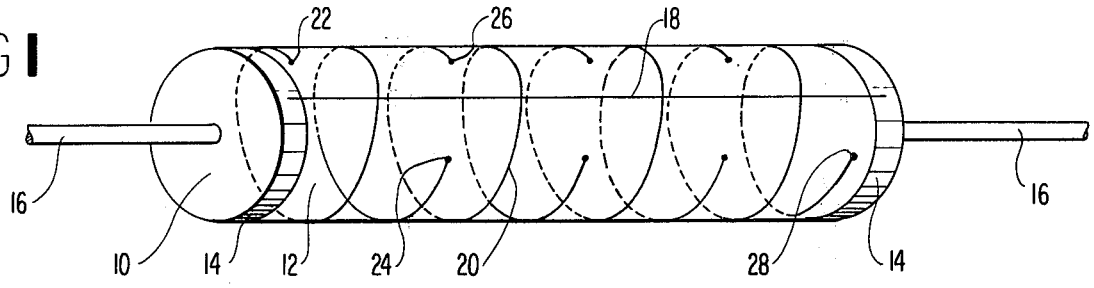
FIG. 1 is a perspective view of a resistor according to the invention.

A resistor made according to the invention is shown in FIG. 1 and comprises an insulating substrate 10 having a cylindrical shape, a thin resistive film 12 applied to the outer surface of the cylinder, termination bands 14 and connecting leads 16. Connecting leads 16 are electrically attached to conductive film 12 to provide a complete electrical path through the resistor. Hermetic sealing or other forms of encapsulation known in the art may be provided, but have been omitted from FIG. 1 for purposes of clarity. Termination bands 14 are formed of gold or other highly conductive material and serve to minimize the alteration of resistance characteristics due to end caps which may be attached to the resistor as part of the encapsulation. Since the bands are highly conductive, the exact point at which the end caps contact the termination bands will not be critical to the resistance characteristics of the resistor.

Insulating substrate 10 may be hollow or a solid cylinder. It is preferably made of a ceramic material composed of 96% alumina ($Al_2O_3$) such as Alumina #614 sold by 3M Technical Ceramics of Laurens, S.C. Although this material is preferable, obviously any other suitable insulating material such as alkaline earth porcelain, may be used without exceeding the scope of the invention.

The thin conductive film 12 is preferably a nickel chromium alloy having an approximate composition of 75% nickel, 20% chromium and 5% trace metals. Other conductive films may also be used, such as carbon film, tin oxide film, and tantalum nitride film.

The thin conductive film 12 may be applied to substrate 10 by the vacuum evaporation method. In this method, a high electrical current is passed through a nickel-chromium filament while under a high vacuum. These conditions cause the surface of the filament to vaporize and the ceramic substrate passing through the vapor is covered with a thin film of the metal. Other methods, such as sputtering, electron beam deposition spraying, dipping, rolling, screening and ion plating are also within the scope of this invention.

After the film 12 has been deposited on substrate 10, the resistor is placed in a standard rotating apparatus 34, such as a lathe, having rotatable shafts 36 and 38 with means to grip the resistor between them. Laser 40, having axially movable arm 42, is used to direct a beam onto the resistor to make axial cut 18 and interrupted spiral cut 20 through the resistive film. The operation of laser 40 is controlled by optical switch 44 in conjunction with light source 46 and control disk 48. Control disk 48 rotates with shaft 50 which may be driven by rotating mechanism 34 via a gearbox 52 so as to rotate at one half the speed of shafts 36 and 38. Gearbox 52 may be replaced by a frictional drive mechanism or any other drive means without exceeding the scope of the invention.

Figure 3:
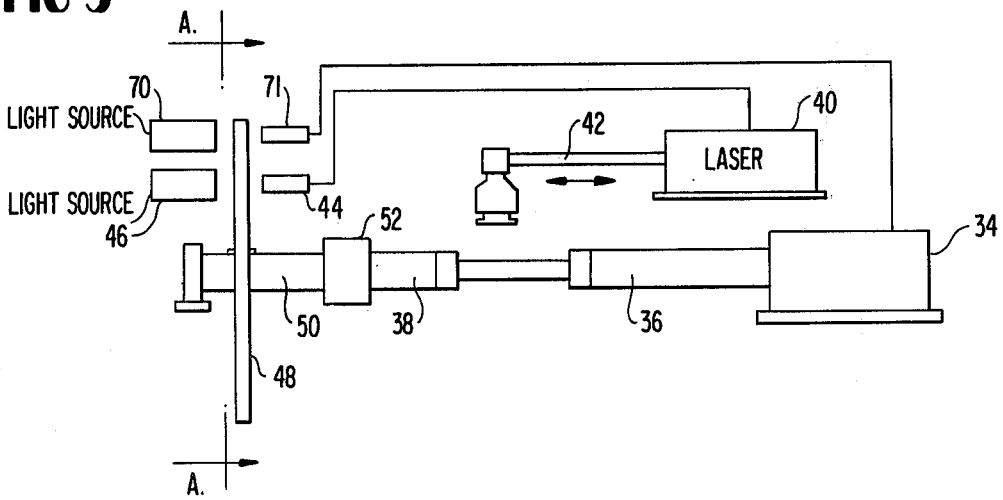
FIG. 3 is a schematic view of the apparatus used to make the axial and interrupted spiral cuts in the resistor of FIG. 1.
Figure 4:
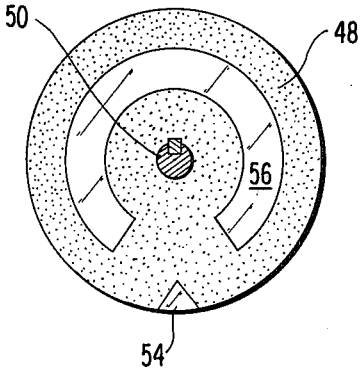
FIG. 4 is a front view of the control disk of FIG. 3.

Light switches 44 and 71, and light sources 46 and 70 are positioned such that control disk 48 extends between them as shown in FIG. 3. Control disk 48 is generally opaque, but has transparent portions 54 and 56 that allow passage of light from light sources 46 and 70 to activate light switches 44 and 71, respectively. When the transparent portion 54 is aligned between light source 70 and light switch 71, rotating device 34 is stopped and movable laser arm 42 traverses along the length of the resistor directing the beam onto the resistor to make axial cut 18 through the resistive film. Rotating device 34 is then turned on, either manually or by automatic means actuated by movement of laser arm 42. Laser 40 is turned on as long as transparent portion 56 passes between light source 46 and light switch 44. The rotation of the resistor, coupled with the longitudinal movement of laser arm 42 forms interrupted spiral cut 20 in the resistive film. The opaque portion of disk 48 between the ends of transparent portion 56 turns the laser beam off as the resistor continues to rotate and arm 42 continues its movement so as to form the interruptions in the spiral cut.

The cut is started at 22 and the cylinder is rotated approximately 690° before the laser beam is cut off at point 24. The cylinder continues to rotate for approximately 30° more before the laser beam is again turned on to continue the spiral cut at point 26. This operation is continued until end point 28 is reached, thereby forming the interrupted spiral cut. The degree of rotation while the laser beam is off may, of course, be varied to vary the gap in the spiral cut depending upon the size and the desired characteristics of the resistor.

Figure 2:
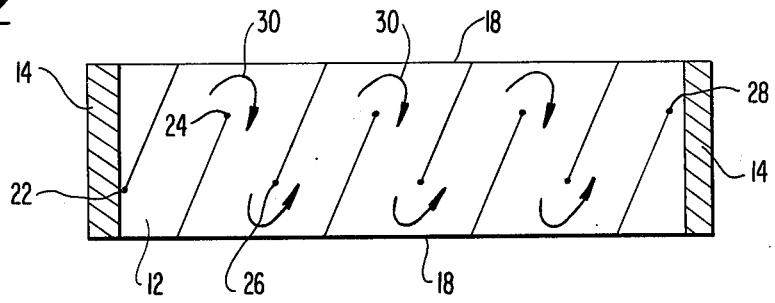
FIG. 2 is a developed view of the cylindrical surface of the resistor of FIG. 1.

FIG. 2 is a developed view of the thin film 12 i.e. a view showing thin film 12 as if it were "unwrapped" from substrate 10 and laid flat. Axial cut 18 is defined by the longitudinal edges shown in FIG. 2. As can be seen, the axial and interrupted spiral cuts form a serpentine path through which the current travels in opposite directions in adjacent portions of the path, the resistor is non-inductive.

Although the invention has been described using a laser beam to cut through the conductive film, it is understood that other methods, such a grinding wheel, or air abrasive cutting can also be used.

What is claimed is:

1. A low-inductance electrical resistor comprising a generally cylindrical insulating substrate with a thin electrically resistance film covering substantially its entire exterior surface, and connecting leads electrically connected to said resistive film, said resistive film having a plurality of cuts therethrough, one extending substantially the length of the resistor generally parallel to its longitudinal axis and another extending in an interrupted spiral so as to define a serpentine electrical path along the length of the resistor.

2. The electrical device of claim 1 wherein the substrate is a hollow cylinder.

3. The electrical device of claim 1 wherein said substrate is a solid cylinder.

4. The electrical device of claim 1 wherein the substrate is a ceramic material.

5. The electrical device of claim 4 wherein the ceramic material is 96% Alumina ($Al_2O_3$).

6. The electrical device of claim 4 wherein the ceramic material is alkaline earth porcelain.

7. The electrical device of claim 1 wherein the thin electrically resistive film is a nickel chromium alloy.

8. The electrical device of claim 7 wherein the composition of the nickel chromium alloy is 75% nickel, 20% chromium and 5% trace metals.

9. The electrical device of claim 1 wherein the thin electrically resistive film is deposited carbon.

10. The electrical device of claim 1 wherein the thin electrically resistive film is tin oxide.

11. The electrical device of claim 1 wherein the thin electrically resistive film is tantalum nitride.

* * * * *